US006712256B1

(12) United States Patent
Curry

(10) Patent No.: US 6,712,256 B1
(45) Date of Patent: Mar. 30, 2004

(54) NAIL GUN CARRIAGE

(76) Inventor: Kevin James Curry, 10441 Spiva Rd., Sacramento, CA (US) 95829

( * ) Notice: Subject to any disclaimer, the term of this patent is extended or adjusted under 35 U.S.C. 154(b) by 45 days.

(21) Appl. No.: 10/000,193

(22) Filed: Oct. 25, 2001

(51) Int. Cl.[7] ..... B25C 7/02

(52) U.S. Cl. ..... 227/111; 227/110; 227/120; 227/130

(58) Field of Search ..... 227/7, 8, 110, 227/111, 120, 130

(56) References Cited

U.S. PATENT DOCUMENTS 2,457,984 A * 1/1949 Dougherty ..... 227/111
3,173,593 A * 3/1965 Elliott ..... 227/111
3,796,365 A * 3/1974 Downing ..... 227/111
3,930,604 A * 1/1976 Pitkin et al. ..... 227/110
3,935,983 A * 2/1976 Buttriss ..... 227/110
3,984,040 A * 10/1976 Fry ..... 227/111
4,732,307 A * 3/1988 Hubbard et al. ..... 227/111
5,062,562 A * 11/1991 Michael ..... 227/111
5,110,027 A * 5/1992 Burlingame ..... 227/110
5,749,508 A * 5/1998 Clothier ..... 227/111

* cited by examiner

*Primary Examiner*—Scott A. Smith
*Assistant Examiner*—Nathaniel Chukwurah

(57) ABSTRACT

A nail gun carriage 10 is provided to support a nail gun 2 adjacent a surface such as a board B to be nailed by the nail gun 2. The nail gun carriage 10 includes at least one wheel 30 or other bearing surface which is located and oriented to rest directly against the boards B to be nailed by the nail gun 2 when the nail gun 2 attached to the nail gun carriage 10 is positioned properly for firing a nail into the board B. The wheel 30 is preferably rotatably supported by a frame 20 which is slidably attached to the nail gun 2. Alignment brackets 40 attach to the nail gun 2 and slidably attach to the frame 20 to keep the nail gun 2 aligned along a firing axis of the nail gun 2 during recoil and relative movement of the nail gun 2 with relationship to the frame 20.

11 Claims, 5 Drawing Sheets

NAIL GUN CARRIAGE

FIELD OF THE INVENTION

The following invention relates to nail guns which deliver nails into structures to be fastened with the nails, such as planar building materials. More particularly, this invention relates to assemblies which are attachable to a nail gun to support the nail gun directly adjacent a surface to be nailed and with a user controlling the position and operation of the nail gun from a convenient location remote from the nail gun, such as standing erect upon the surface being nailed. The carriage assembly of this invention can be configured to attach to an existing nail gun or be incorporated into the design of the nail gun itself to form a single integrated mechanism.

BACKGROUND OF THE INVENTION

To enhance the efficiency of framing wooden buildings and other structures, framers and carpentry professionals often use a nail gun as an at least partial replacement for a hammer. Such nail guns deliver a nail into the structure with power most typically supplied by compressed air from a compressor or other compressed air supply. One such nail gun known in the prior art is made by the Hitachi Company of Japan under the model number "NV 83A" and referred to as a "3¼ inch coil nailer." The nail gun is operated by placing a muzzle of the nail gun adjacent a location where a nail is desired and then pulling a trigger adjacent a grip of the nail gun to cause a nail to be delivered out of the muzzle with sufficient force to drive the nail into the structure. A magazine is typically attached to the nail gun and sequentially feeds nails into the nail gun for subsequent delivery.

Many common structural members used in framing a building are planar in nature, including plywood, oriented strand board, and other planar lumber. Such planar building materials are often used to provide flooring, walls and roofing structure for a building. Nails are utilized to attach these planar building materials to underlying studs, joists and other structural members of the building. Nail guns are particularly useful in quickly executing the repetitive process of driving nails into such planar building materials along the perimeter and regions over underlying structural members.

One drawback of utilizing a nail gun is the substantial weight of the nail gun and associated magazine. This weight is particularly undesirable when using the nail gun on flooring and roofing because the carpenter or other user is typically required to stand on the surface to be nailed and awkwardly bend down to hold the nail gun adjacent the surface upon which the carpenter is standing.

Additionally, different structural applications for planar building materials specify different optimal spacings between adjacent nails. The closer actual nail spacing matches the optimal spacing, the quicker a structure of adequate strength can be created, with fewer nails required. Accordingly, a need exists for an assembly to carry a nail gun along a surface which facilitates operation of the nail gun by a user while the user is standing erect on the same surface being nailed. Such an assembly would additionally benefit from facilitating precise spacing of adjacent nails relative to each other with a distance matching an optimal spacing specified for the application to which the planar building material is being directed.

SUMMARY OF THE INVENTION

This invention provides a nail gun carriage which is attachable to a nail. gun and supports the nail gun in proper position relative to an underlying planar structure to effectively deliver a nail into the underlying structure. The carriage facilitates remote firing and position control of the nail gun by a user while the user stands erect upon the surface being nailed. The nail gun carriage includes at least one wheel or other bearing support coupled, either directly or indirectly through other structures, to the nail gun. The wheel or other bearing support is located and oriented relative to a muzzle of the nail gun so that the wheel or other bearing support can roll or slide along the underlying structure, such as planar building material to be nailed, with the muzzle of the nail gun located and oriented for proper firing of a nail into the structure.

Preferably, a frame is slidably attached to the nail gun and rotatably supports the wheel. Alignment brackets can be affixed to the nail gun and include pins which slide within slots in the frame such that the nail gun is limited to linear motion parallel to a firing axis of the nail gun. In this way, a recoil action exhibited by the nail gun immediately after firing a nail is accommodated, and the wheel or other bearing support of the carriage is allowed to remain adjacent the planar structure being nailed. Preferably, a spring is provided to bias the nail gun to its desired position with the muzzle directly adjacent the surface to be nailed before firing a nail.

The nail gun carriage additionally features an extension handle, preferably in the form of an elongate pole, which is coupled at least indirectly to the nail gun. Most preferably, a grip bracket is attached to a grip of the nail gun with the grip bracket accommodating attachment of the pole to the grip bracket. The pole can attach to the grip bracket in one of a variety of different orientations which give the pole a variety of different angular orientations relative to the nail gun and nail gun carriage. A carpenter or other user can then grasp an end of the pole opposite the grip bracket and have control over the positioning and movement of the nail gun and nail gun carriage. The pole is sufficiently long so the user can stand erect on the same surface that is being nailed by the nail gun with the nail gun carriage of this invention resting upon this surface.

The nail gun is fired in at least two different ways. First, a manual trigger can be included near an end of the pole opposite the grip bracket attached to the nail gun. This manual trigger is coupled via a cable to the gun trigger so that when the manual trigger is toggled by the user the trigger of the nail gun is actuated. The remote firing of the nail gun by the user at the opposite end of the pole is thus accomplished.

A second firing mechanism provides automatic firing as the nail gun carriage travels over a predetermined distance on the structure being nailed. Such an automatic trigger actuator could take a variety of different forms to measure the distance over which the nail gun carriage has traveled. A user could select a desired spacing between nails (i.e. four inches) so that the nail gun fires a nail when that desired distance has been traveled by the nail gun carriage. Uniform spacing of the nails is thus provided. One form of automatic trigger actuator includes a flexible axle coupled at one end to the wheel of the nail gun carriage and at the other end to a cam adjacent the gun trigger of the nail gun. As the wheel of the nail gun carriage rotates, a lobe on the cam rotates and toggles the gun trigger. The diameter of the wheel can be selected to provide the desired spacing between nails. A transmission can be included along the flexible axle to allow a user to vary an amount of rotation out of the transmission and affect the rate of rotation of the cam and hence the distance traveled between consecutive firings of the nail gun.

OBJECTS OF THE INVENTION

Accordingly, a primary object of the present invention is to provide a nail gun carriage which allows a nail gun to be operated adjacent a structure to be nailed while a user is remote from the nail gun.

Another object of the present invention is to provide a nail gun carriage which holds the nail gun at a proper position and orientation relative to an adjacent structure to be nailed.

Another object of the present invention is to provide a nail gun carriage which can move along a planar surface to be nailed with the user controlling the position of the nail gun remotely.

Another object of the present invention is to provide a nail gun carriage which facilitates firing of nails into a planar surface with a user controlling the position of the nail gun while the user stands erect upon the surface being nailed.

Another object of the present invention is to provide a nail gun support assembly which holds the nail gun adjacent a surface to be nailed and accommodates recoil of the nail gun after firing and return of the nail gun to proper orientation for delivery of subsequent nails.

Another object of the present invention is to provide a nail gun support assembly which is configured to automatically fire a nail from the nail gun when a predetermined distance has been traveled by the nail gun adjacent a surface to be nailed.

Another object of the present invention is to provide a nail gun which can rest upon an underlying planar surface and be moved over the underlying planar surface by a user standing erect upon the underlying planar surface with nails being fired from the nail gun into the underlying planar surface.

Other further objects of the present invention will become apparent from a careful reading of the included drawing figures, the claims and detailed description of the invention.

DESCRIPTION OF THE PREFERRED EMBODIMENT

Figures 1, 2:
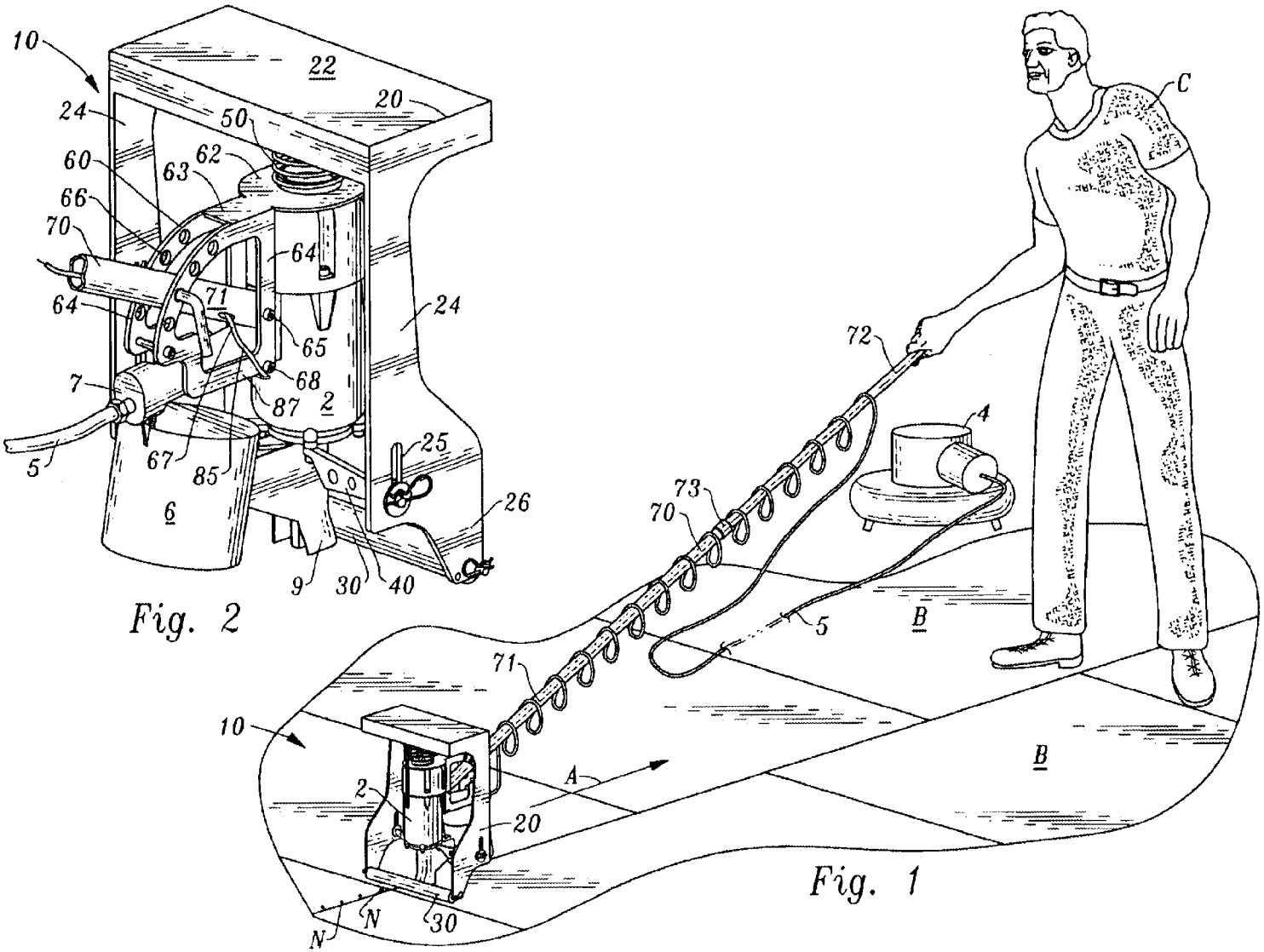
FIG. 1 is a perspective view of the nail gun carriage in a preferred embodiment of this invention attached to a nail gun and resting upon boards forming a planar structure with a user standing upon the boards and controlling a position of the nail gun carriage and nail gun remotely through a pole attached to the nail gun.
FIG. 2 is a perspective view of the nail gun carriage and nail gun of this invention assembled together for use in delivering nails into a planar structure.

Referring to the drawings wherein like reference numerals represent like parts throughout the various drawing figures, reference numeral 10 is directed to a nail gun carriage (FIG. 1) which supports a nail gun 2 above boards B or other planar structures in an orientation allowing nails N to be fired from the nail gun 2 into the boards B. A pole 70 provides a preferred form of extension handle which can be grasped by a user, such as a carpenter C, while the carpenter C conveniently stands erect on the boards B parallel with the boards B or other planar structures being nailed by the nail gun 2.

In essence, and with particular reference to FIGS. 1 and 2, the basic details of the nail gun carriage 10 are described. The nail gun carriage 10 includes a frame 20 which is preferably slideably attached to the nail gun 2. A wheel 30 or other bearing surface is provided on a lower end of the frame 20 at a position which allows the wheels 30 to roll (or bearing surface to slide) on the boards B to be nailed by the nail gun 2. Alignment brackets 40 (FIG. 2) are preferably affixed to the nail gun 2 and ride in slots 25 formed in the frame 20 so that the nail gun 2 can slide relative to the frame 20 to accommodate recoil of the nail gun 2 immediately after firing a nail N. A recoil spring 50 is oriented between a rear of the nail gun 2 and the frame 20.

A grip bracket 60 (FIG. 2) is coupled to the nail gun 2 preferably at a location surrounding a grip 7 of the nail gun 2. The grip bracket 60 provides an attachment location for a pole 70 which can be handled by a carpenter C and used to position the nail gun carriage 10 where desired from a standing position remote from the nail gun carriage 10. A manual trigger actuator 80 (FIGS. 6–9) can be provided to allow for remote firing of the nail gun 2 by hands of the carpenter C from a proximal end 72 of the pole 70 (FIG. 1) distant from the nail gun carriage 10. An automatic trigger actuator 90 (FIG. 10) can be provided which causes the nail gun 2 to fire automatically as the wheel 30 turns so that nails N are automatically periodically driven into the boards B underlying the nail gun carriage 10 at a desired user selected spacing.

Figure 5:
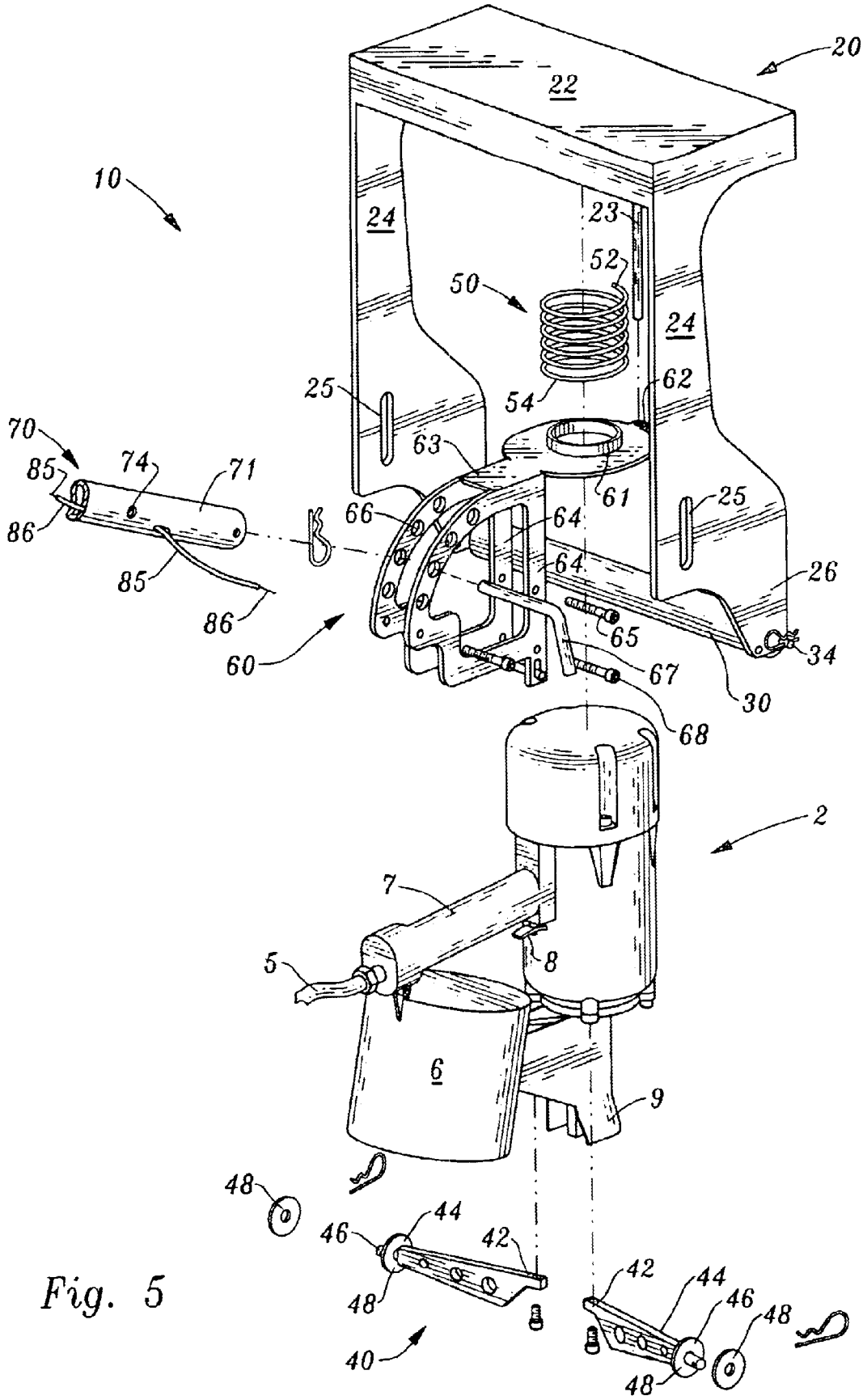
FIG. 5 is a perspective exploded parts view of that which is shown in FIG. 2.

More specifically, and with particular reference to FIG. 5, details of the nail gun 2 most preferred for attachment to the nail gun carriage 10 are described. While any type of nail gun 2 could be utilized with an appropriately modified nail gun carriage 10 to accommodate the particular design of the nail gun 2, a preferred form of nail gun 2 is made by the Hitachi Company of Japan under the model number "NV 83A" and referred to as a "3¼ inch coil nailer." This nail gun 2 is driven by a compressor 4 delivering compressed air or other gas through a line 5 to a connector in the grip 7 of the nail gun 2. A magazine 6 stores a plurality of nails in a manner which can be rapidly and sequentially fed to the nail gun 2 for firing out of a muzzle 9 along a firing axis when a gun trigger 8 is actuated. The actual nail gun firing mechanism of the nail gun 2 can be referred to separately from other portions of the nail gun 2 by the phrase "nail firing gun."

A preferred form of this invention provides the nail gun carriage 10 as an accessory attachable to an existing nail gun 2, such as the nail gun described in detail above., However, the nail gun carriage 10 could be integrated with the nail gun 2 so that a new form of nail gun 2 would be provided which includes the wheel 30 or other bearing surface and optionally the pole 70 with the design of the nail gun 2 modified to integrate these features of the nail gun carriage 10 directly into a redesigned nail gun 2. Hence, both nail gun carriages 10 attachable to existing nail guns 2 and nail guns 2 modified to include the features of the nail gun carriage 10 are contemplated as acceptable variations within the scope of this invention.

With particular reference to FIGS. 2–5, details of the frame 20 and wheel 30 of the nail gun carriage 10 are described. The frame 20 is not strictly necessary for operation of a most basic form of the nail gun carriage 10 of this invention. However, according to a preferred embodiment of this invention the frame 20 is included to provide for slidable. coupling of the wheel 30 to the nail gun 2. Particularly, the frame 20 includes a cap 22 which is preferably substantially planar with two side walls 24 extending perpendicularly down from the cap 22 to tips 26. A post 23 preferably extends down from a forward edge of the cap 22 to assist in aligning the nail gun 2 relative to the frame 20, as discussed in detail below. A pair of slots 25 are provided, one in each of the side walls 24, with the slots 25 having a long axis oriented preferably substantially vertically and perpendicular to an orientation of the cap 22. The slots 25 act as part of a sliding coupling to assist in aligning movement of the nail gun 2 relative to the frame 20, as discussed in detail below.

The wheel 30 extends between the tips 26 of each of the side walls 24 and preferably perpendicular to the nail firing axis of the nail gun 2. Preferably, the wheel 30 is an elongate cylinder with a 1¼ inch diameter exterior cylindrical rolling surface 32. The wheel 30 preferably rotates upon an axle 34 which is mounted to the tips 26 of the frame 20. The cylindrical surface 32 preferably is configured of a material and a texture having sufficient friction to easily overcome rolling resistance between the wheel 30, the axle 34 and the tips 26 of the frame 20, such that the wheel 30 does not slide on an underlying boards B or other adjacent structures to be nailed, but rather preferably always rolls.

While the above described wheel 30 configuration is preferred, a variety of different wheel 30 configurations can be provided as alternatives. For instance, multiple wheels 30 could be aligned along a common axle 34 or on multiple axles parallel to each other. The diameter of the wheels 30 could also be modified.

While utilization of a wheel 30 is preferred to provide a bearing surface for the nail gun carriage 10 which can rest upon boards B or other structures to be nailed, other bearing surfaces could be provided. For instance, a wheel 30 which does not rotate could be provided with the wheel 30 merely sliding over the bearing surface. Similarly, a series of skids, runners, skis or rails could also similarly be utilized. Another alternative bearing surface would be a rolling track.

The wheel 30 or other bearing surface is oriented to roll (or slide) along the boards B or other structure to be nailed and to have a location and orientation relative to the muzzle 9 of the nail gun 2 which properly places the nail gun 2 where needed for properly delivering nails N into the boards B underlying the carriage 10. For instance, if it is desirable with a particular nail gun 2 for the muzzle 9 to be lightly touching the boards B, the wheel 30 can be located so that the cylindrical surface 32 of the wheel 30 has a position horizontally forward of the muzzle 9 of the nail gun 2 and at a common height with the muzzle 9. If it is desirable that the muzzle 9 be slightly off of the boards B to be nailed, the wheel 30 can be located so that the cylindrical surface 32 of the wheel 30 is forward and slightly below the muzzle 9 of the nail gun 2. In either event, the orientation of the wheel 30 on the nail gun carriage 10 and relative to the muzzle 9 of the nail gun 2 is preferably provided to position the muzzle 9 precisely where needed for optimum performance of the nail gun 2. If desired this positioning can be made adjustable to accommodate different circumstances in which the nail gun 2 is to be used.

Most preferably, the wheel 30 is oriented forward of the muzzle 9 of the nail gun 2 slightly. In this way, the wheel 30 would roll off of an edge of the board B before the muzzle 9 of the nail gun 2 would be off of the board B and potentially be capable of firing a nail N into a location where the board B is not present and potentially pose a danger to others. It is also desirable that the wheel 30 be oriented with a midpoint of the wheel directly adjacent the muzzle 9 of the nail gun 2 so that a majority of the wheel 30 is resting upon the boards B when the muzzle 9 of the nail gun 2 is also over a board B. In this way, if the nail gun carriage 10 is laterally extending over a side of a board B the nail gun carriage 10 will tend to tip off of the board B once it is in a location where a nail N might be fired into a location other than where the boards B are present.

The wheel 30 or other bearing surface is preferably attached to the frame 20 as described above. However, the wheel 30 or other bearing surface could be attached directly to the nail gun 2 or attached to the nail gun 2 through other structures in the frame 20. Any such other attachment arrangements could still provide the wheel 30 in the desired position as described above. If the wheel 30 is attached directly and rigidly to the nail gun 2, nail gun 2 recoil would cause the wheels 30 to hop off of the boards B along with the wheel 30. If the wheel 30 is attached directly to the nail gun 2 in a manner allowing the wheel 30 to move down during recoil, the wheel 30 could be kept in substantial contact with the boards B and maintain alignment of the nail gun 2 along an edge of the board B to be nailed. By providing the frame 20 in the preferred fashion described above, the nail gun 2 recoils but the frame 20 and wheel 30 remain in contact with the boards B so that after recoil is complete the nail gun 2 returns to its original position and is ready for firing of a second nail N after the nail gun carriage 10 has been moved (such as along arrow A of FIG. 1) to the next location where a nail N is to be fired.

Figure 4:
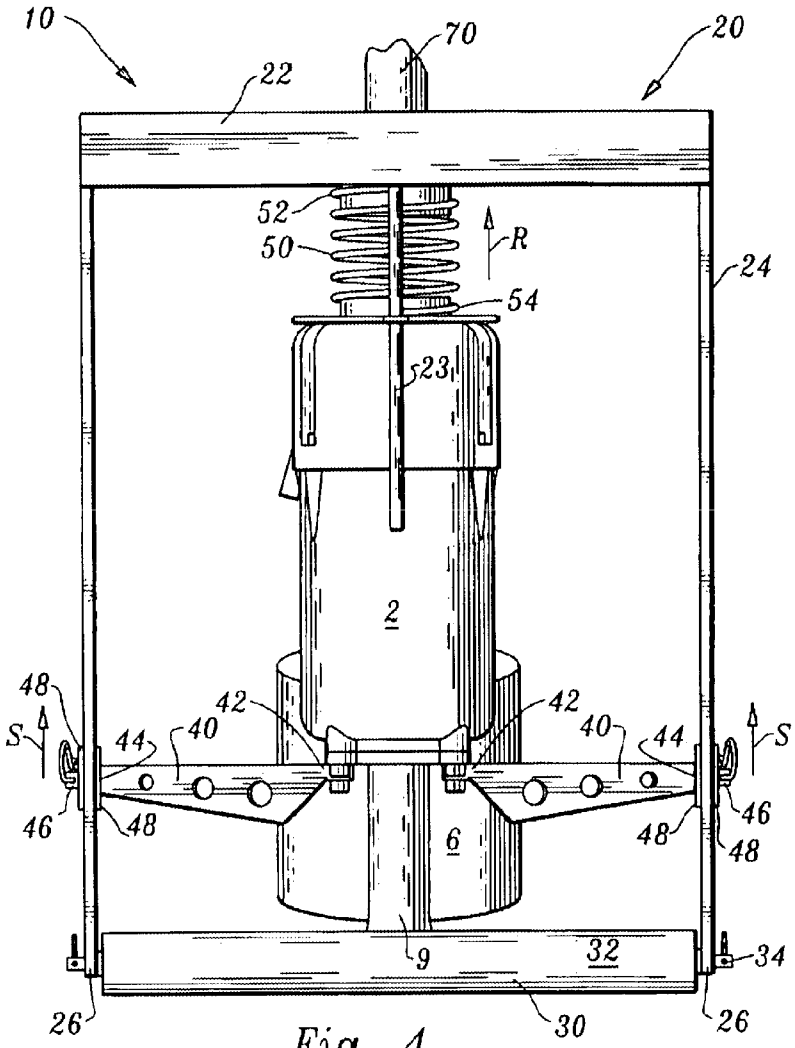
FIG. 4 is a front elevation view of that which is shown in FIG. 2.
Figure 3:
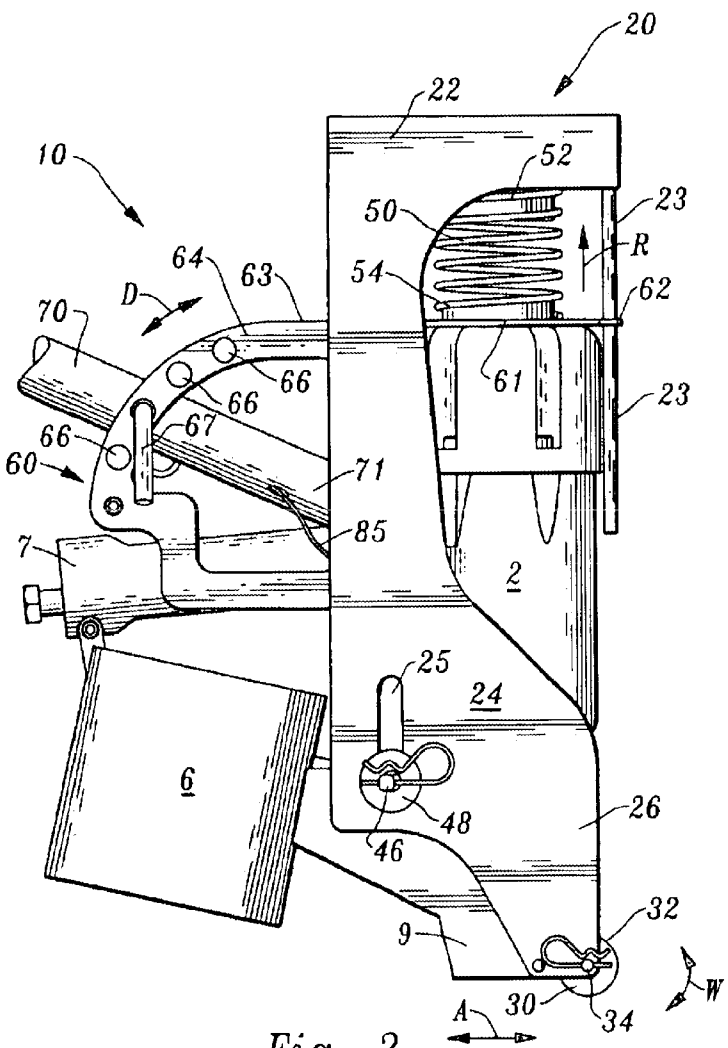
FIG. 3 is a side elevation view of that which is shown in FIG. 2.

With particular reference to FIGS. 3–5, details of the alignment brackets 40 are described. Preferably, two alignment brackets. 40 are affixed directly to the nail gun 2, such as through removal and reattachment of appropriate bolts of. the nail gun 2 at a location where the muzzle 9 interfaces with other portions of the nail gun 2. The attachment brackets 40 are rigid structures which extend horizontally and laterally away from the nail gun 2. The alignment brackets 40 include inner ends 42 attached to the nail gun 2 and outer ends 44 distant from the inner ends 42. Pins 46 are preferably located at the outer ends 44 which pass through the slots 25 in the frame 20. Washers 48, cotter pins and other structures can be provided to retain the, pins 46 of the alignment brackets 40 within the slots 25.

The pins 46 of the alignment brackets 40 are allowed to pivot up and down (such as along arrow S of FIG. 4) within the slots 25. For instance, when the nail gun 2 is fired and recoils upward (along arrow R of FIG. 4) the pins 46 of the alignment brackets 40 slide up (along arrow S of FIG. 4) within the slots 25. The alignment brackets 40 and slots 25 coact to keep the nail gun 2 precisely aligned relative to the frame 20 so that only linear translation parallel to the firing axis of the nail gun 2 is allowed between the frame 20 and the nail gun 2.

The attachment brackets 40 can alternatively be a single bracket 40 extending entirely between the two side walls 24 of the frame 20 and affixed directly or indirectly to the nail gun 2. It is also conceivable that the post 23 of the frame 20 could merely provide for alignment of the nail gun 2 relative to the frame 20 without the alignment brackets 40 being strictly necessary for at least minimal operation of the nail gun carriage 10 and nail gun 2 of this invention.

A recoil spring 50 is preferably located between a rear of the nail gun 2, opposite the muzzle 9, and the cap 22 of the frame. 20. The recoil spring 50 is not strictly necessary, but is beneficial in keeping the nail gun 2 aligned in its proper position for firing except when recoil forces overcome a force exerted by the recoil spring 50. Immediately after firing the nail gun 2, the nail gun 2 recoils upwards. (such as along arrow R of FIGS. 3 and 4).

The weight of the frame 20 keeps the wheel 30 in approximately its previous position and the recoil spring 50 is compressed. The nail gun 2 is then returned to its original position due to forces of gravity and the recoil spring 50 returning the nail gun 2 to its original position. When utilizing the nail gun carriage 10 on vertical surfaces or surfaces with a steep slope, the recoil spring 50 is particularly advantageous to keep the nail gun 2 adjacent the structure being nailed. The recoil spring 50 includes an upper end 52 which is attached to the cap 22 and lower end 54 which is attached either directly to the rear of the nail gun 2 or to a portion of the grip bracket 60 described below.

With particular reference to FIGS. 2, 3 and 5, details of the grip bracket 60 are described. The grip bracket 60 serves the primary purpose of facilitating attachment of an extension handle, such as the pole 70, to the nail gun carriage 10 so that a user such as a carpenter C can stand erect upon the boards B to be nailed and control a position of the nail gun carriage 10 and delivery of nails N while the nail gun carriage 10 is resting upon the boards B.

The grip bracket 60 is preferably rigidly affixed to the nail gun 2. The grip, bracket 60 includes a spring base 61 which extends over a rear end of the nail gun 2 and provides for attachment of the lower end 54 of the recoil spring 50 to the spring base 61. The spring base 61 preferably includes a front hole 62 which is sized to receive the post 23 of the frame 20 passing there through. Because the grip bracket 60 is fixedly attached to the nail gun 2 and the post 23 is affixed to the frame 20, the post 23 slides through the front hole 62 during recoil. This arrangement helps to maintain alignment of the nail gun 2 during recoil with relative motion between the nail gun 2 and the frame 20 limited to translation along the firing axis without relative rotation.

A top plate 63 extends rearwardly from the spring base 61 in a substantially horizontal fashion. Lateral plates 64 extend perpendicularly down from the top plate 63 parallel to each other and with a spacing similar to a width of the grip 7 of the nail gun 2 and a width of the pole 70. The lateral plates 64 include a pivot bolt 65 passing through each of the lateral plates 64 at a location adjacent the nail gun 2. The lateral plates 64 include orientation holes 66 at spaced intervals along an upward and rearward arcuate perimeter of each of the lateral plates 64.

An orientation pin 67 is sized to pass through adjacent pairs of orientation holes 66 in the two lateral plates 64. The orientation pin 67 preferably includes a bend and an extension to allow the orientation pin 67 to be easily grasped by a hand of the user for removal and reinsertion when desired. At least one capture bolt 68 and preferably multiple capture bolts extend between the two lateral plates 64 adjacent a lower portion of the lateral plates 64 and adjacent the grip 7 of the nail gun 2 to capture the grip 7 securely between the lateral plates 64 so that the grip bracket 60 remains securely affixed to the nail gun 2.

With particular reference to FIGS. 1–3, details of the pole 70 are described. The pole 70 provides a preferred form of extension handle to allow the carpenter C or other user to stand erect at a location remote from the nail gun carriage 10 and still control positioning and operation of the nail gun 2 within the nail. gun carriage 10. Specifically, the pole 70 preferably includes two nesting cylindrical segments, with a longer diameter segment having a hollow interior to allow segments to rest. The segments are removably attachable together by an adjustment collar 73 so that the pole 70 can be adjusted in length.

A first pivot end 71 of the pole 70 is located adjacent the grip bracket 60. The pivot end 71 includes a hole passing there through which can receive the pivot bolt 65 of the grip bracket 60 so that the pivot end 71 of the pole 70 is captured by the grip bracket 60. A second proximal end 72 of the pole 70 is provided where the carpenter C can grasp the pole 70 and control the position of the nail gun carriage 10.

An alignment bore 74 passes through the pole 70 at a location slightly spaced from the pivot end 71 a distance similar to a distance from the pivot bolt 65 to the various orientation holes 66 in the lateral plates 64 of the grip bracket 60. The alignment bore 74 is large enough to receive the orientation pin 67 there through. Hence, when the alignment bore 74 is aligned with a pair of orientation holes 66, the orientation pins 67 can be utilized to secure the pole 70 to the grip bracket 60 at a second location spaced from the pivot bolt 65. In this way, the pole 70 is secured to the grip bracket 60, and hence the nail gun 2, without relative rotation or translation there between.

The orientation holes 66 are provided for alignment with the alignment bore 74, so that the pole 70 provides an angle of the pole 70 relative to the grip bracket 60, nail gun 2 and nail gun carriage 10 which is most comfortable for the carpenter C depending on the slope of the boards B to be nailed, a height of the carpenter C, a length of the pole 70 and other considerations of ergonomics and expediency.

While the above described pole 70 configuration is preferred, a variety of different extension handles could be utilized. For instance, if attributes of the nail gun carriage 10 are integrated directly into a nail gun 2, it is conceivable that the grip 7 would merely be constructed to be configured as a pole or other elongate structure. Two poles 70 or other extension handles could be provided which either attach to the grip bracket 60 at a single location or attach to laterally spaced portions of the grip bracket 60. Such a multiple pole 70 or extension handle configuration would more easily allow a carpenter C or other user to control a rotational orientation of the nail gun carriage 10.

While the pole 70 or other extension handle preferably attaches to the grip bracket 60 and hence directly to the nail gun 2, an alternative would be to have the pole 70 or other extension handle attach to the frame 20 or other support structure coupling the wheels 30 or other bearing surface to the nail gun 2. In such an arrangement, the pole 70 or other extension handle would still be coupled to the nail gun 2, but in an indirect fashion through other intervening structures. If desired, the pole 70 can be configured to include the line 5 of compressed air either within an interior thereof or along an exterior thereof to minimize the need to manage the location of the line 5 during use of the nail gun 2 and the nail gun carriage 10.

With particular reference to FIGS. 6–9, details of a manual trigger actuator 80 of the nail gun carriage. 10 of this invention are described. While the nail gun carriage 10 described hereinabove is generally operable to control proper positioning of the nail gun 2 in a convenient manner while the carpenter C stands erect upon the board B to be nailed, it is desirable that the carpenter C be able to cause the nail gun 2 to fire without needing to grasp the gun trigger 8 of the nail gun 2 with hands of the carpenter C in a direct fashion. A variety of different remotely controlled trigger actuators could be resorted to to provide for firing of the nail gun 2. For instance, the remote control devices utilizing appropriate frequencies could operate in a wireless fashion and have servo-motors, solenoids or other actuators which would receive a signal from a control device with the carpenter C to cause the nail gun 2 to fire. Other means to actuate the gun trigger 8 could include an electrically coupled switch and solenoid with the switch adjacent the carpenter C and the solenoid adjacent the gun trigger 8 and with appropriate wiring there between so that when the carpenter C actuates the switch, the trigger 8 is toggled.

Most preferably, the manual trigger actuator 80 described in FIGS. 6–9 is provided. A manual trigger 81 is provided near the proximal end 72 of the pole 70. A guard 82 surrounds the manual trigger 81 to prevent accidental toggling of the manual trigger 81. a torsion spring 83 biases the manual trigger 81 in a first position. A rod 84 is coupled to the manual trigger 81 with a cable 85 attached to the rod 84. The cable 85 can reside within a sleeve 86 (optionally) and extends from the proximal end 72 of the pole 70 down to near the pivot end 71 of the pole 70 where the cable 85 passes out of the pole 70 and over to the gun trigger 8. The cable 85 can optionally be routed entirely outside of the pole 70 or partially inside the pole 70 and partially outside the pole 70 as desired.

By including a sleeve 86 around the cable 85, the sleeve 85 and cable 86 combination can be coiled up inside the pole 70 somewhat to accommodate lengthening and shortening of the pole 70. So long as the ends of the sleeve 86 are grounded to ends of the pole 70, the cable 85 will move relative to the sleeve 86 and the cable 85 will appropriately move both adjacent the manual trigger 81 and adjacent the gun trigger 8. A gun trigger coupling 87 is provided which attaches the cable 85 to the gun trigger 8.

Figure 6:
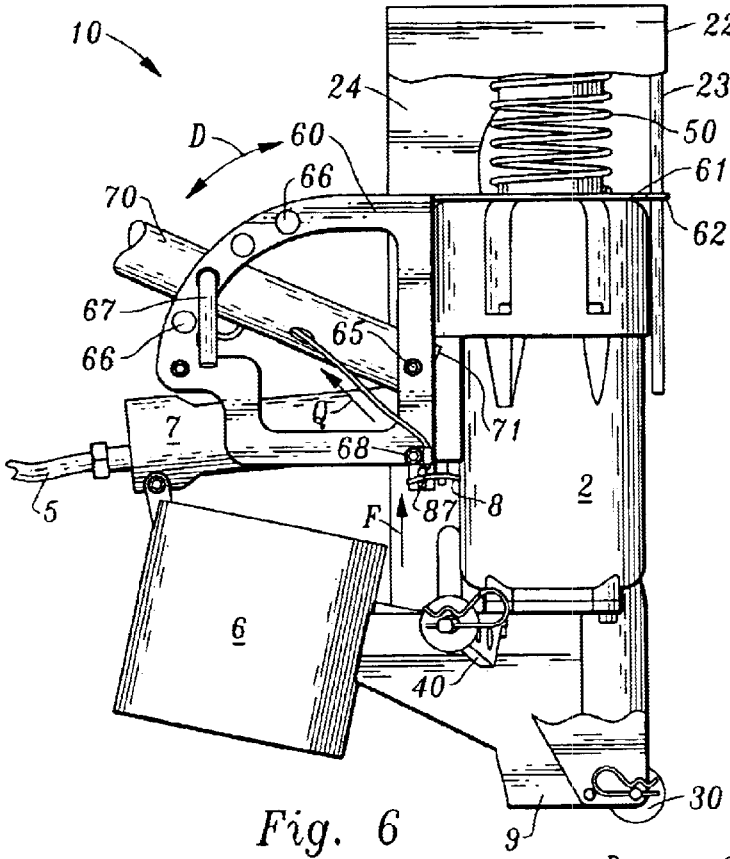
FIG. 6 is a side elevation view similar to that which is shown in FIG. 3 with portions of a frame of the nail gun carriage removed to show details of a grip bracket and gun trigger interface of this invention.
Figure 7:
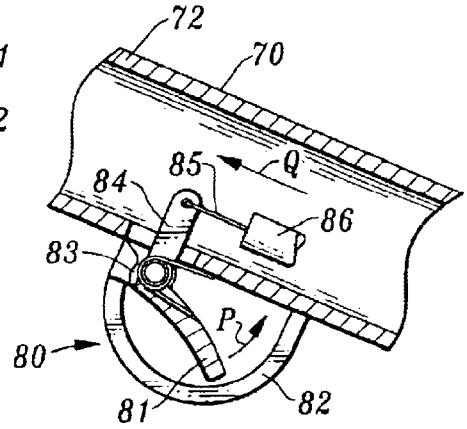
FIG. 7 is a detail of a manual trigger within the pole of this invention.
Figure 8:
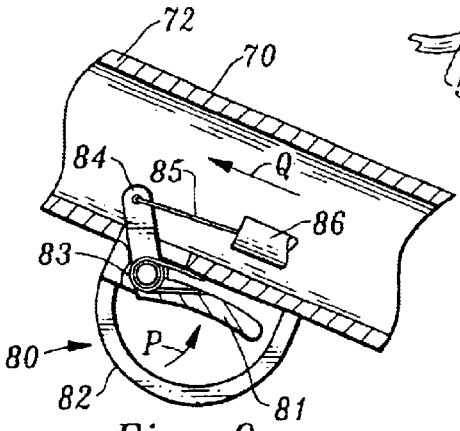
FIG. 8 is a sectional view similar to that which is shown in FIG. 7 after toggling of a manual trigger to cause the nail gun to fire remotely.
Figure 9:
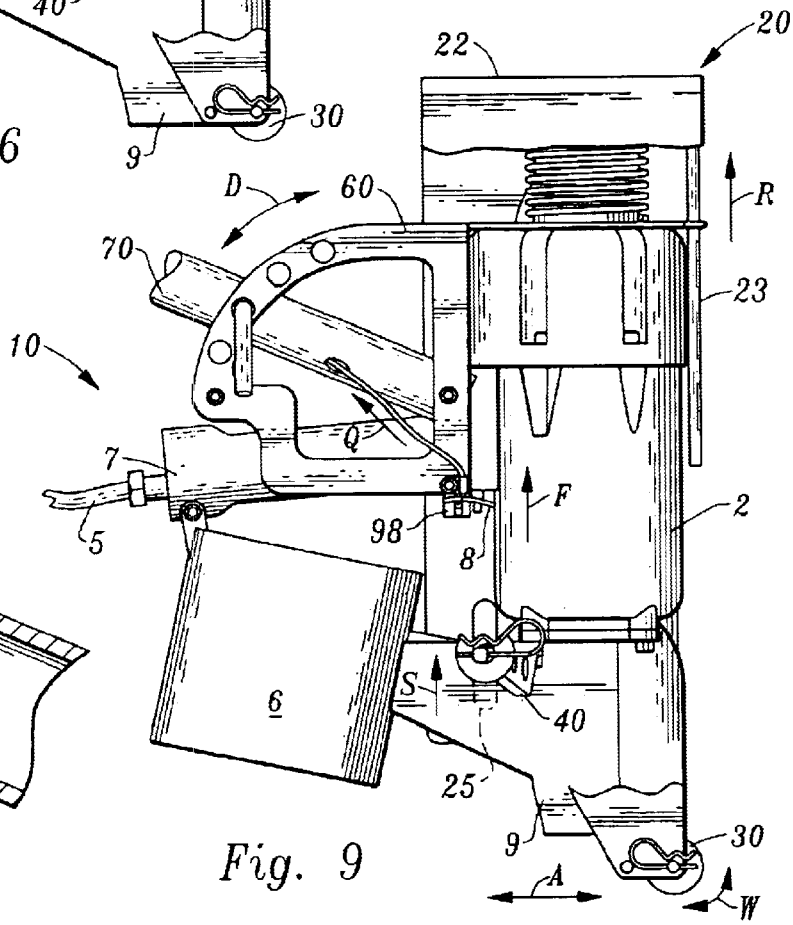
FIG. 9 is a side elevation cut away view similar to that which is shown in FIG. 6 after actuation of the gun trigger of the nail gun through action of the manual trigger actuator of this invention.
Figure 10:
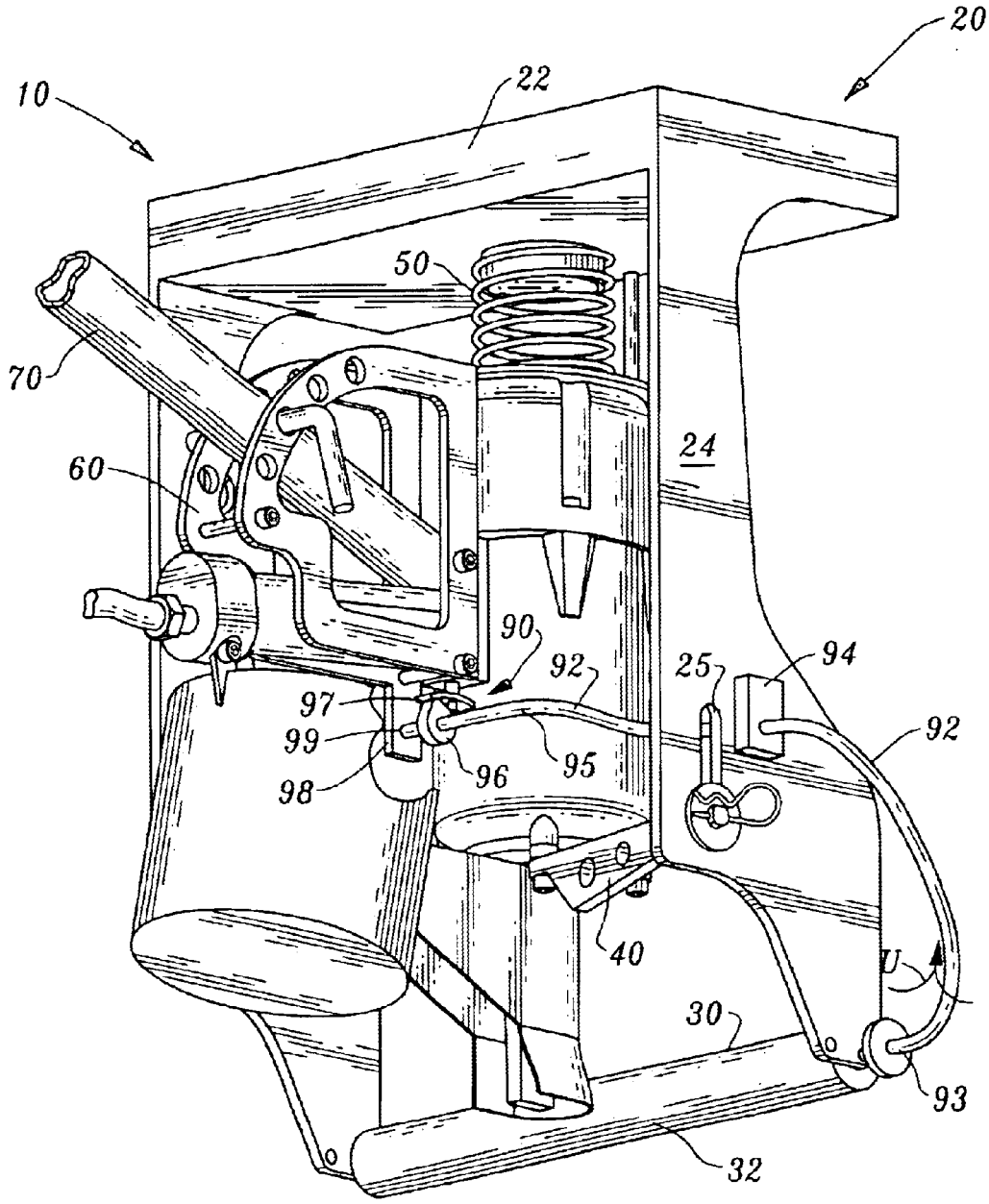
FIG. 10 is a perspective view of an alternative embodiment of that which is shown in FIG. 2 which includes an automatic trigger actuator to cause the nail gun to fire a nail upon periodic travel of the nail gun carriage over an adjacent surface to be nailed.

When the manual trigger 81 is toggled (such as along arrow P of FIGS. 7 and 8) the rod 84 pulls the cable 85 (along arrow Q of FIGS. 7 and 8), causing the cable 85 to move adjacent the pivot end 71 of the pole 70 (along arrow Q of FIGS. 6 and 9) and causing the gun trigger 8 to be toggled (along arrow F of FIGS. 6 and 9). In this way, the gun trigger 8 is remotely toggled and a nail N delivered from the nail gun 2.

Most preferably, the nail gun carriage 10 of this invention includes both the manual trigger actuator 80 described above and an automatic trigger actuator 90 so that the carpenter C has two different systems which can be utilized to cause firing of the nail gun 2. The automatic trigger actuator 90 system causes the nail gun 2 to fire based on an amount of movement of the nail gun carriage 10 relative to the boards B or other structures to be nailed. For instance, if it is desired that nails be spaced four inches apart, the automatic trigger actuator would be set by the carpenter C to fire a nail gun 2 every four inches. As the nail gun carriage 10 moves, a nail N will be delivered by the nail gun 2 every four inches. If the carpenter C prefers a three inch spacing, the automatic trigger actuator 90 is preferably adjustable through a manual firing frequency adjustment to accommodate such a three inch spacing and deliver a nail every three inches as the nail gun 10 moves over the boards B to be nailed.

This basic functionality of the automatic trigger actuator 90 could be provided in a variety of different ways. For instance, one means to automatically trigger the nail gun would include an optical sensor mounted to either the nail gun 2 or the nail gun carriage 10 (i.e. the frame 20, the grip bracket 60 or the pole 70) and be directed at the boards B or other underlying structures with the appropriate optical and/or electric circuitry to detect motion of the nail gun carriage 10 and nail gun 2 over the boards B or other underlying surfaces. When the amount of spacing distance desired and selected by the carpenter C has been passed, the nail gun 2 would be caused to fire. Other means to measure nail gun 2 travel and automatically trigger the nail gun 2 could also be utilized.

Most preferably, an automatic trigger actuator 90 is provided which senses an amount of wheel 30 rotation and causes the gun trigger 8 of the nail gun 2 to be toggled in a periodic fashion as the wheel 30 of the nail gun carriage 10 rotates a distance similar to the desired distance for spacing between nails N to be delivered from the nail gun 2.

For instance, a flexible axle 92 (FIG. 10) can be provided with a wheel interface 93 at one end, a cam interface 95 at a second end and optionally with a transmission 94 along the flexible axle 92. A cam 96 would be located adjacent the cam interface 95. This cam 96 would be directly adjacent the gun trigger 8 and include a lobe which would cause the gun trigger 8 to be toggled when the lobe passes adjacent the gun trigger 8 due to rotation of the cam 96. The cam 96 can be securely positioned directly adjacent the trigger 8 such as upon a cam rotational support pin 97 pivotably attached within a hole 99 in a tab 98 attached to the grip bracket 60. When the wheel 30 rotates, the flexible axle 92 rotates adjacent the wheel interface 93. This rotation of the flexible axle 92 would in turn cause rotation of the flexible axle 92 adjacent the cam interface 95 where the flexible axle 92 would be coupled to a center of rotation of the cam 96 and cause the cam 96 to rotate. An alternative to the flexible axle 92 is an arrangement of flexible belts and shafts to deliver a wheel rotation signal from the wheel 30 to the cam 95.

If the wheel 30 has a diameter of 1¼ inches, a nail spacing of approximately four inches is provided with a single lobed cam and no transmission 94. A simplest form of this invention would not require a transmission 94. However, to allow selection of automatic nail N spacing, the transmission 94 could be interposed upon the flexible axle 92. Such a transmission 94 could be attached to the frame 20 and have an input rotational velocity different from an output rotational velocity in a manner which could be selected, such as by rotating a manual dial or pushing buttons on an exterior of the transmission 94. The transmission 94 could include planetary gears, separate sets of gears which can be selectively engaged with each other, interfacing clutch-like mechanisms or any other speed reduction or speed increase transmission devices known in the prior art.

The transmission 94 could thus be utilized so that the user could select a frequency of nail firing and hence periodic amount of travel between nails delivered from the nail gun 2. The flexible axle 92 is merely one form of input signal to the transmission with axle 92 rotation correlating with an amount of movement relative to the surface being nailed. As the nail gun carriage 10 advances along the boards B to be nailed (arrow A of FIG. 9) the wheel 30 is caused to turn (along arrow W of FIG. 9). With the embodiment of this invention shown in FIG. 10, the flexible axle 92 would be caused to rotate (such as along arrow U of FIG. 20) in turn causing the cam 96 to rotate and causing the gun trigger 8 to be toggled (such as along arrow F of FIGS. 6 and 9).

Both the manual trigger actuator 80. and the automatic trigger actuator 90 could be simultaneously provided on the nail gun carriage 10 of this invention. In such an arrangement, the nail gun carriage 10 would automatically cause the nail gun 2 to fire in a periodic fashion with a spacing selected by the carpenter C. Additionally, should the carpenter C wish for an additional nail N to be provided, such as at an end of the board B, the carpenter C can manually toggle the manual trigger 81, and cause the gun trigger 8 to be fired at the precise location desired.

This disclosure is provided to reveal a preferred embodiment of the invention and a best mode for practicing the invention. Having thus described the invention in this way, it should be apparent that various different modifications can be made to the preferred embodiment without departing from the scope and spirit of this disclosure. When structures are identified as a means to perform a function, the identification is intended to include all structures which can perform the function specified. When structures of this invention are identified as being coupled together, such language should be interpreted broadly to include the structures being coupled directly together or coupled together through intervening structures. Such coupling could be either in a rigid fashion or in a fashion which allows pivoting, sliding or other relative motion while still providing some form of attachment. It is understood that the frame 20 of this invention could be omitted or take on a variety of different configurations other than those specifically shown in the drawings and the grip bracket 60 as well as other structures of this invention according to the preferred embodiment could be significantly modified and still provide the basic functions of these portions of the nail gun carriage 10.

What is claimed is:

1. A nail gun carriage for supporting a nail gun adjacent a surface to be nailed, comprising in combination:

at least one wheel coupled at least indirectly to the nail gun, said wheel having a rolling surface;

said wheel and the nail gun position relative to each other such that when said rolling surface is oriented to roll on the surface to be nailed, a muzzle of the nail gun is in position to deliver a nail into the surface to be nailed;

wherein at least one extension handle is coupled at least indirectly to the nail gun, said extension handle configured to be held by a user's hand when the user's hand is remote from the nail gun;

wherein said extension handle includes a pole with a first end at least indirectly coupled to the nail gun and a second end opposite said first end configured to be held by a user's hand when the user's hand is remote from the nail gun;

wherein said first end of said pole is at least indirectly affixed to the gun in a manner precluding non-rotational movement of said first end of said pole relative to the gun; and wherein said first end of said pole is pivotably attached to a grip bracket directly affixed to a grip of the nail gun.

2. The carriage of claim 1 wherein said grip bracket includes a plurality of orientation holes thereon, wherein said pole includes an alignment bore spaced from said first end of said pole by a distance similar to a spacing between said orientation holes and a location where said first end of said pole is pivotably attached to said grip bracket, such that said orientation bore can be aligned with each of said orientation holes; and wherein an orientation pin is provided that is removably locatable through said orientation bore in said pole and through at least one of said orientation holes in said grip bracket, such that said pole can be fixed relative to said grip bracket and the nail gun at a variety of different relative angles between said pole and the nail gun.

3. The carriage of claim 1 wherein said pole includes at least two nesting elongate cylindrical segments with said segments of different diameters and with at least a larger of said segments having a hollow interior such that said segments can nest together and a length of said pole can be adjusted.

4. A nail gun carriage for supporting a nail gun adjacent a surface to be nailed, comprising in combination:

at least one wheel coupled at least indirectly to the nail gun, said wheel having a rolling surface;

said wheel and the nail gun position relative to each other such that when said rolling surface is oriented to roll on the surface to be nailed, a muzzle of the nail gun is in position to deliver a nail into the surface to be nailed;

wherein said wheel is movably coupled to the nail gun to accommodate at least some recoil motion of the nail gun relative to said wheel when the nail gun is fired to deliver a nail;

wherein said wheel is rotatably mounted to a frame, said frame slidably mounted to the nail gun;

wherein a spring is coupled at least indirectly between said frame and an end of the nail gun opposite the muzzle;

wherein said frame includes slots extending linearly in a direction parallel with a firing axis of the nail gun, at least one alignment bracket affixed to the nail gun and extending through at least one of said slots to slide within at least one of said slots when the nail gun moves relative to said frame; and wherein a post is coupled to said frame and extends along a line parallel to the firing axis of the nail gun, and a hole is affixed to the nail gun with said post passing through said hole, such that movement of the nail gun relative to said frame is restricted to movement along the firing axis of the nail gun with all movement of the nail gun relative to said frame restricted to linear motion parallel to the firing axis of the nail gun.

5. A nail gun carriage for supporting a nail gun adjacent a surface to be nailed, comprising in combination:

at least one wheel coupled at least indirectly to the nail gun, said wheel having a rolling surface;

said wheel and the nail gun position relative to each other such that when said rolling surface is oriented to roll on the surface to be nailed, a muzzle of the nail gun is in position to deliver a nail into the surface to be nailed;

wherein said wheel is at least indirectly coupled to an automatic gun trigger with gun trigger actuation corresponding with rotation of said wheel;

wherein firing of said automatic gun trigger occurs at a regular interval associated with a distance traveled by said nail gun carriage as measured by rotation of said wheel;

wherein a cam is located adjacent said gun trigger, said cam rotatably coupled to said wheel such that said cam rotates as said wheel rotates, said cam having a lobe which causes the gun trigger to be actuated as said lobe rotates past the gun trigger; and wherein a flexible axle extends between said wheel and a center of rotation of said cam.

6. A nail gun carriage for supporting a nail gun adjacent a surface to be nailed, comprising in combination:

at least one wheel coupled at least indirectly to the nail gun, said wheel having a rolling surface;

said wheel and the nail gun position relative to each other such that when said rolling surface is oriented to roll on the surface to be nailed, a muzzle of the nail gun is in position to deliver a nail into the surface to be nailed;

wherein said wheel is at least indirectly coupled to an automatic gun trigger with gun trigger actuation corresponding with rotation of said wheel;

wherein firing of said automatic gun trigger occurs at a regular interval associated with a distance traveled by said nail gun carriage as measured by rotation of said wheel;

wherein a cam is located adjacent said gun trigger, said cam rotatably coupled to said wheel such that said cam rotates as said wheel rotates, said cam having a lobe which causes the gun trigger to be actuated as said lobe rotates past the gun trigger; and wherein a transmission is interposed between said wheel and said cam, said transmission receiving wheel rotation as input and outputting cam rotation, said cam rotation rate is different from a rate of rotation of said wheel.

7. The carriage of claim 6 wherein said transmission is adjustable by a user, such that a spacing of nails automatically delivered into the surface to be nailed can be adjusted to match a user selected spacing desired between adjacent nails.

8. A nail gun adapted for use to deliver nails into planar surfaces, comprising in combination:

a nail storage magazine;

a nail firing gun coupled to said nail storage magazine, said gun having a muzzle from which a nail is fired;

at least one bearing surface at least indirectly coupled to said gun;

said bearing surface oriented to contact the surface being nailed when said muzzle is in position to deliver a nail into the surface being nailed;

wherein said bearing surface includes at least one wheel rotatably coupled at least indirectly to said nail firing gun; and wherein said wheel is rotatably mounted to a frame, said frame slidably coupled to said nail firing gun with a slidable coupling oriented to allow said nail firing gun to slide relative to said frame in a direction parallel with said nail firing axis of said nail firing gun.

9. The nail gun of claim 8 wherein said frame includes two side walls extending down from a cap to tips, said tips rotatably supporting ends of an elongate cylinder forming said wheel, said side walls each including a slot therein forming a portion of said slidable coupling with a long axis of said slots aligned with said nail firing axis, at least one bracket affixed to said nail firing gun, said bracket having a length sufficient to extend from said nail firing gun through each of said slots with pins sized to slide within said slots, a spring interposed between said nail firing gun and said cap of said frame, an alignment post fixed to said cap of said frame and extending along a line parallel to said nail firing axis and a hole fixed to said nail firing gun and located with said post passing through said hole, such that said nail firing gun is restricted to motion parallel to said nail firing axis relative to said frame.

10. A nail gun carriage for supporting a nail gun adjacent a surface to be nailed, comprising in combination:

at least one wheel coupled at least indirectly to the nail gun, said wheel having a rolling surface;

said wheel and the nail gun position relative to each other such that when said rolling surface is oriented to roll on the surface to be nailed, a muzzle of the nail gun is in position to deliver a nail into the surface to be nailed;

wherein said wheel is rotatably mounted to a frame, said frame slidably mounted to the nail gun;

wherein said frame includes slots extending linearly in a direction parallel with a firing axis of the nail gun, at least one alignment bracket affixed to the nail gun and extending through at least one of said slots to slide within at least one of said slots when the nail gun moves relative to said frame; and wherein a post is coupled to said frame and extends along a line parallel to the firing axis of the nail gun, and a hole is affixed to the nail gun with said post passing through said hole, such that movement of the nail gun relative to said frame is restricted to movement along the firing axis of the nail gun with all movement of the nail gun relative to said frame restricted to linear motion parallel to the firing axis of the nail gun.

11. A nail gun adapted for use to deliver nails into planar surfaces, comprising in combination:

a nail storage magazine;

a nail firing gun coupled to said nail storage magazine, said gun having a muzzle from which a nail is fired;

at least one bearing surface at least indirectly coupled to said gun;

said bearing surface oriented to contact the surface being nailed when said muzzle is in position to deliver a nail into the surface being nailed; and wherein said bearing surface is coupled to a frame, said frame slidably coupled to said nail firing gun with a slidable coupling oriented to allow said nail firing gun to slide relative to said frame in a direction parallel with said nail firing axis of said nail firing gun.

* * * * *